US005407372A

United States Patent [19]

Mondek et al.

[11] Patent Number: 5,407,372

[45] Date of Patent: Apr. 18, 1995

[54] OUTBOARD MOTOR COVER ASSEMBLY

[75] Inventors: Martin J. Mondek, Wonder Lake; Donald K. Sullivan, Prospect Heights; Scott N. Burmeister, Gurnee; Clarence E. Blanchard, Kenosha; James S. Nerstrom, Green Oaks, all of Ill.

[73] Assignee: Outboard Marine Corporation, Waukegan, Ill.

[21] Appl. No.: 126,549

[22] Filed: Sep. 24, 1993

[51] Int. Cl.[6] ..... B63H 1/15

[52] U.S. Cl. ..... 440/52; 440/76

[58] Field of Search ..... 440/49, 50, 51, 52, 440/76, 77, 78

[56] References Cited

U.S. PATENT DOCUMENTS

| | | | |
|---|---|---|---|
| 2,740,368 | 4/1956 | Irgens et al. . | |
| 2,911,936 | 11/1959 | Kiekhaefer . | |
| 2,916,007 | 12/1959 | Kiekhaefer . | |
| 3,002,489 | 10/1961 | Watkins . | |
| 3,045,423 | 7/1962 | Hulsebus . | |
| 3,127,866 | 4/1964 | Mohr . | |
| 3,358,668 | 12/1967 | Post et al. . | |
| 3,599,594 | 8/1971 | Taipale | 115/17 |
| 3,750,615 | 8/1973 | Haft et al. . | |
| 3,773,010 | 11/1973 | Elingsen | 115/17 |
| 3,782,321 | 1/1974 | Elingsen . | |
| 3,934,537 | 1/1976 | Hall | 115/17 |
| 3,955,526 | 5/1976 | Kusche | 115/17 |
| 4,348,194 | 9/1982 | Walsh | 440/77 |
| 4,507,090 | 3/1985 | Kobayashi et al. . | |
| 4,698,037 | 10/1987 | Watanabe et al. | 440/78 |
| 4,708,673 | 11/1987 | Dunham et al. | 440/77 |
| 4,723,927 | 2/1988 | Walsh et al. | 440/77 |
| 4,800,854 | 1/1989 | Boda et al. | 123/195 |
| 4,867,120 | 9/1989 | Boda et al. | 123/195 |
| 4,963,110 | 10/1990 | Otani et al. | 440/89 |
| 4,979,918 | 12/1990 | Breckenfeld et al. . | |
| 5,055,074 | 10/1991 | Westberg et al. | 440/77 |
| 5,135,239 | 8/1992 | Kato et al. | 440/76 |
| 5,192,235 | 3/1993 | Dunham et al. . | |

FOREIGN PATENT DOCUMENTS 64-11569 1/1989 Japan .

*Primary Examiner*—Stephen P. Avila

[57] ABSTRACT

Disclosed herein is an outboard motor comprising a propulsion unit including a lower unit having port and starboard sides and comprising a drive shaft housing having an upper end, a power head including an engine fixedly attached to said upper end of said drive shaft housing, and an engine cover assembly comprising a starboard lower cover member extending downwardly to said lower end of said drive shaft housing and including an inwardly open recess, a port lower cover member extending downwardly to said lower end of said drive shaft housing and including an inwardly open recess, and means connecting together said port and starboard cover members independently of said lower unit and in surrounding covering relation to said drive shaft housing, and means resiliently supporting said lower cover members on said lower unit and including rubber mounts respectively extending from said port and starboard sides of said lower unit and into said inwardly open recesses of said lower cover members.

17 Claims, 2 Drawing Sheets

Fig. 1
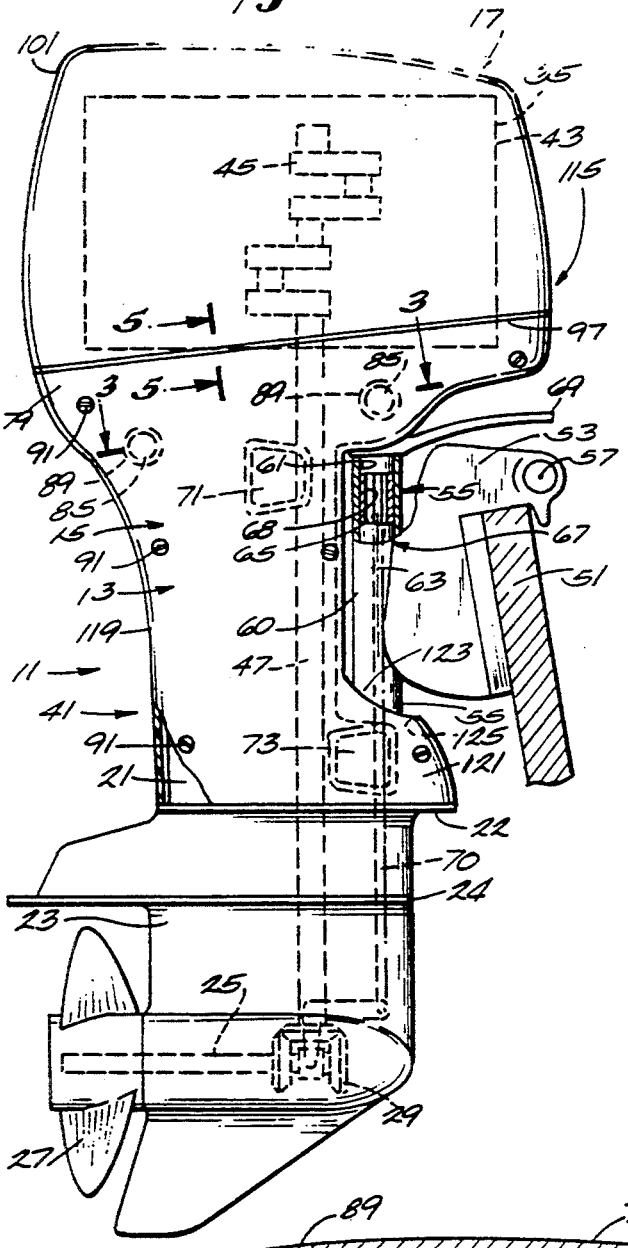
Fig. 2
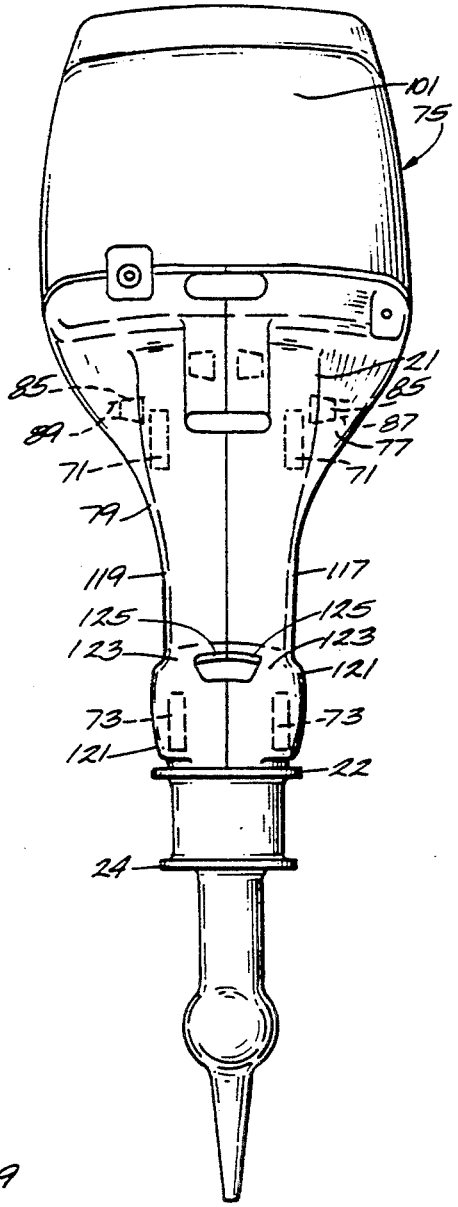
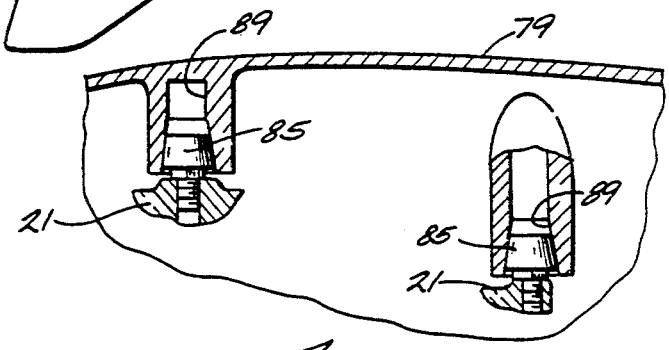
Fig. 3

OUTBOARD MOTOR COVER ASSEMBLY

BACKGROUND OF THE INVENTION

The invention relates generally to marine propulsion devices, such as outboard motors, and to cover assemblies for the power head and drive shaft housings of such outboard motors. In the past, much expense has been involved in the finishing of the outer surface of the drive shaft housing of outboard motors so as to provide an aesthetically pleasing appearance.

The invention also relates to sealing arrangements for such cover assemblies.

Attention is directed to the constructions shown in the following references:

| UNITED STATES PATENTS | | |
|---|---|---|
| 2,740,368 | Irgens, et al. | April 3, 1956 |
| 2,911,936 | Kiekhaefer | November 10, 1959 |
| 2,916,007 | Kiekhaefer | December 8, 1959 |
| 3,002,489 | Watkins | October 3, 1961 |
| 3,045,423 | Hulsebus | July 24, 1962 |
| 3,127,866 | Mohr | April 7, 1964 |
| 3,358,668 | Post, et al. | December 19, 1967 |
| 3,599,594 | Taipale | August 17, 1971 |
| 3,750,615 | Haft, et al. | August 7, 1973 |
| 3,773,010 | Elingsen | November 20, 1973 |
| 3,782,321 | Ellingsen | January 1, 1974 |
| 3,934,537 | Hall | January 27, 1976 |
| 3,955,526 | Kusche | May 11, 1976 |
| 4,348,194 | Walsh | September 7, 1982 |
| 4,507,090 | Kobayashi, et al. | March 26, 1985 |
| 4,698,037 | Watanabe, et al. | October 6, 1987 |
| 4,708,673 | Dunham, et al. | November 24, 1987 |
| 4,723,927 | Walsh, et al. | February 9, 1988 |
| 4,800,857 | Boda, et al. | January 31, 1989 |
| 4,867,120 | Boda, et al. | September 19, 1989 |
| 4,979,918 | Breckenfeld, et al. | December 25, 1990 |
| 5,055,074 | Westberg, et al. | October 8, 1991 |
| 5,192,235 | Dunham, et al. | March 9, 1993 |
| FOREIGN | | |
| Japanese Patent Application No. 64-11569 | | |

SUMMARY OF THE INVENTION

The invention provides an outboard motor comprising a propulsion unit including a lower unit comprising a drive shaft housing having an upper end and a lower end, a gear case attached to the lower end of the drive shaft housing, and a propeller supported by the gearcase, a power head including an engine fixedly attached to the upper end of the drive shaft housing, and an engine cover assembly comprising a starboard lower cover member extending downwardly to the lower end of the drive shaft housing, a port lower cover member extending downwardly to the lower end of the drive shaft housing, and means connecting together the port and starboard cover members independently of the lower unit and in surrounding covering relation to the drive shaft housing, and means resiliently supporting the lower cover members on the lower unit.

The invention also provides a cover assembly for a propulsion assembly forming part of an outboard motor, the cover assembly comprising a starboard lower cover including an upper edge, a port lower cover including an upper edge, a top cover having a lower margin with a circumferential groove receiving the upper edges of the lower covers, and a gasket fixed on the upper cover member in the groove and engaged by the upper edge.

The invention also provides an outboard motor comprising a propulsion unit including a lower unit having port and starboard sides and comprising a drive shaft housing having an upper end and a lower end, a gear case attached to the lower end of the drive shaft housing, and a propeller supported by the gearcase, a power head including an engine fixedly attached to the upper end of the drive shaft housing, and an engine cover assembly comprising a starboard lower cover member extending downwardly to the lower end of the drive shaft housing and including an inwardly open recess and an upper edge, a port lower cover member extending downwardly to the lower end of the drive shaft housing and including an inwardly open recess and an upper edge, means connecting together the port and starboard cover members independently of the lower unit and in surrounding covering relation to the drive shaft housing, a top cover surrounding the power head and having a lower margin with a circumferential groove receiving the upper edges of the lower covers, and a gasket fixed on the upper cover member in the groove and engaged by the upper edge, means resiliently supporting the lower cover members on the lower unit.

Other features of and advantages of the invention will become apparent to those skilled in the art upon review of the following detailed description, claims, and drawings.

THE DRAWINGS

FIG. 1 is a side elevational view, partially in section, of one embodiment of an outboard motor incorporating various of the features of the invention.

FIG. 2 is a front elevational view of the outboard motor shown in FIG. 1 and with parts omitted.

FIG. 3 is an enlarged fragmentary sectional view taken generally along line 3—3 of FIG. 1.

Figure 6:
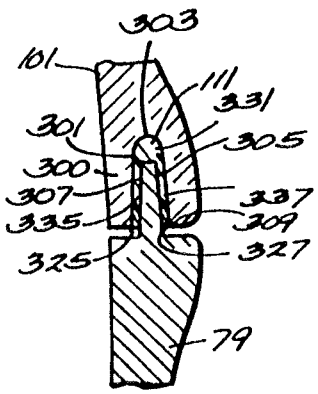
FIG. 6 is a view similar to FIG. 5 showing another embodiment of a sealing arrangement.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Shown in FIG. 1 of the drawings is an outboard motor 11 which includes a steerable and tiltable propulsion unit 13 including, in part, a lower unit 15 and a power head 17.

The lower unit 15 include a drive shaft housing 21 having a port side, a starboard side, upper and lower ends, and a splash plate 22 extending horizontally at the bottom of the lower end of the drive shaft housing 21. The lower unit 15 also includes a gearcase 23 which is rigidly fixed to the lower end of the drive shaft housing 21 and which includes a horizontally extending anti-cavitation plate 24 spaced below the splash plate 22 and a propeller shaft 25 which is mounted for rotation about a fore and aft horizontal axis located in spaced relation below the anti-cavitation plate 24. The rotatably mounted propeller shaft 25 supports a propeller 27 and is connected to a reversing transmission 29.

The power head 17 includes an internal combustion engine 35 which is rigidly fixed to the upper end of the drive shaft housing 21 and which, together with the drive shaft housing 21 and the gearcase, forms a rigid propulsion assembly 41.

The engine 35 includes a schematically shown engine block 43 and a crankshaft 45 which is rotatably supported by the engine block 43 and is drivingly connected to a drive shaft 47 which extends vertically through the drive shaft housing 21 and is drivingly connected to the reversing transmission 29. The engine also includes auxiliary components such as, for example, a fuel feeding means (not shown).

The outboard motor 11 also includes means for tiltably and steerably supporting the rigid propulsion assembly 41 from a boat transom 51. While other constructions can be employed, in the disclosed construction, such means comprises a transom bracket 53 adapted to be fixed to the boat transom 51 and a swivel bracket 55 which is pivotally connected to the transom bracket 53 for vertical tilting movement about a horizontal tilt axis 57. The swivel bracket 55 includes a portion 60 formed with a bore 61 which extends transversely to the tilt axis 57, which defines a steering axis 63, and which rotatably receives a king pin 65 which forms part of a kingpin and steering arm assembly 67. More particularly, at its upper end, the king pin 65 is connected for common steering movement about the steering axis 63 to a steering arm 69 which projects forwardly over the transom bracket 53.

The means for tiltably and steerably supporting the propulsion assembly 41 also includes means connecting the top and bottom of the king pin 65 and the propulsion assembly 41 for vibrationally isolating and supporting the propulsion assembly 41 from the king pin assembly 67, and thus from the swivel bracket 55 and the steering arm 69. Accordingly, the propulsion assembly 41 is therefore mounted for tilting movement relative to the transom bracket 53 in common with the swivel bracket 55 and for steering movement relative to the swivel bracket 55 and transom bracket 53. More particularly, at its upper end, the king pin 65 is connected to the propulsion assembly 41 by one or more upper rubber mounts 71 and is connected, at its lower end, to the propulsion assembly 41 by one or more lower rubber mounts 73. While other constructions can be employed, in the disclosed construction, the upper rubber mount(s) 71 are located near the top of the drive shaft housing 21 and the lower mount(s) 73 are located at the lower end of the drive shaft housing 21 immediately above the splash plate 22. Any suitable rubber mount constructions can be employed.

Extending through a central bore 68 in the king pin 65 is a transmission control rod 70 which extending into the drive shaft housing 21 and the gearcase 23 and, at its lower end, is connected to the reversing transmission 29. At its upper end, the control rod 70 can be serially connected to any desired operator.

The propulsion unit 13 also includes a cover assembly 75 which is resiliently supported from the propulsion assembly 41 and which includes lower port and starboard covers or members 77 and 79 which are supported and vibrationally isolated from the propulsion assembly 41 by means including, see especially FIGS. 2 and 3, rubber mounts 85 which are fixed on the propulsion assembly 41 and received in suitable recesses 87 and 89 formed respectively in the port and starboard covers 77 and 79. Other suitable arrangements can be employed. The resilient mounts 85 are retained in the recesses 87 and 89 by suitably connecting together the port and starboard covers 77 and 79, as for instance, by a plurality of screws or bolts 91 extending horizontally between the covers 77 and 79 and independently of the propulsion assembly 41. Other suitable arrangements can be employed for connecting the lower covers 77 and 79 and for resiliently mounting the covers 77 and 79 from the propulsion assembly 41.

Figure 5:
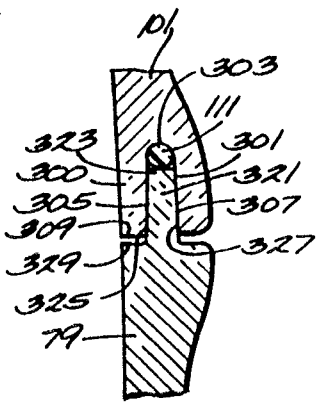
FIG. 5 is a fragmentary sectional view taken along line 5—5 of FIG. 1.

The port and starboard covers 77 and 79 include, see FIG. 5, upper edges 97 which engage and support an upper cover or member 101 which is suitably releasably connected to the lower covers 77 and 79 by means (not shown) and which, in general, encloses or surrounds the power head 17. Preferably a rubber or resilient gasket 111 is provided between the upper cover 101 and the lower covers 77 and 79. In addition, the covers 77, 79, and 101 are preferably fabricated of plastic to provide a smooth and attractive outer surface. The covers 77, 79, and 101 comprise a cover assembly 115.

As thus far disclosed, the construction is conventional.

In order to avoid the costly expense of finishing the outer surface of the drive shaft housing 21 and to permit structural design of the drive shaft housing 21 without regard to aesthetic considerations, the port and starboard covers 77 and 79 respectively include, as shown in FIGS. 1 and 2, skirts 117 and 119 which extend downwardly to the lower end of the drive shaft housing 21, i.e., to below the lower rubber mounts 73 supporting the propulsion assembly 41 from the king pin assembly 67 and to the splash plate 22, thereby substantially totally surrounding and enclosing the drive shaft housing 21. As can be seen in FIG. 2, the skirts 117 and 119 engage each other in the area forwardly of the drive shaft housing 21 and aft of the king pin assembly 67, which engagement extends to the bottom of the skirts.

As shown best in FIGS. 1 and 2, the skirts 117 and 119 respectively include forwardly projecting lower portions 121 which extend slightly laterally outwardly and which project forwardly to enclose the lower rubber mounts 73 and the underlying drive shaft housing 21. The forwardly projecting lower portions 121 include respective upper surfaces 123 formed with vertically extending half openings 125 which form an aperture at least partially surround the swivel bracket portion 60 containing the king pin bore 61 and permit passage thereof into the enclosure formed by the skirts 117 and 119 so that the lower end of the portion 60 of the swivel bracket 55 is located in the enclosure defined by the assembled skirts 117 and 119.

Figure 4:
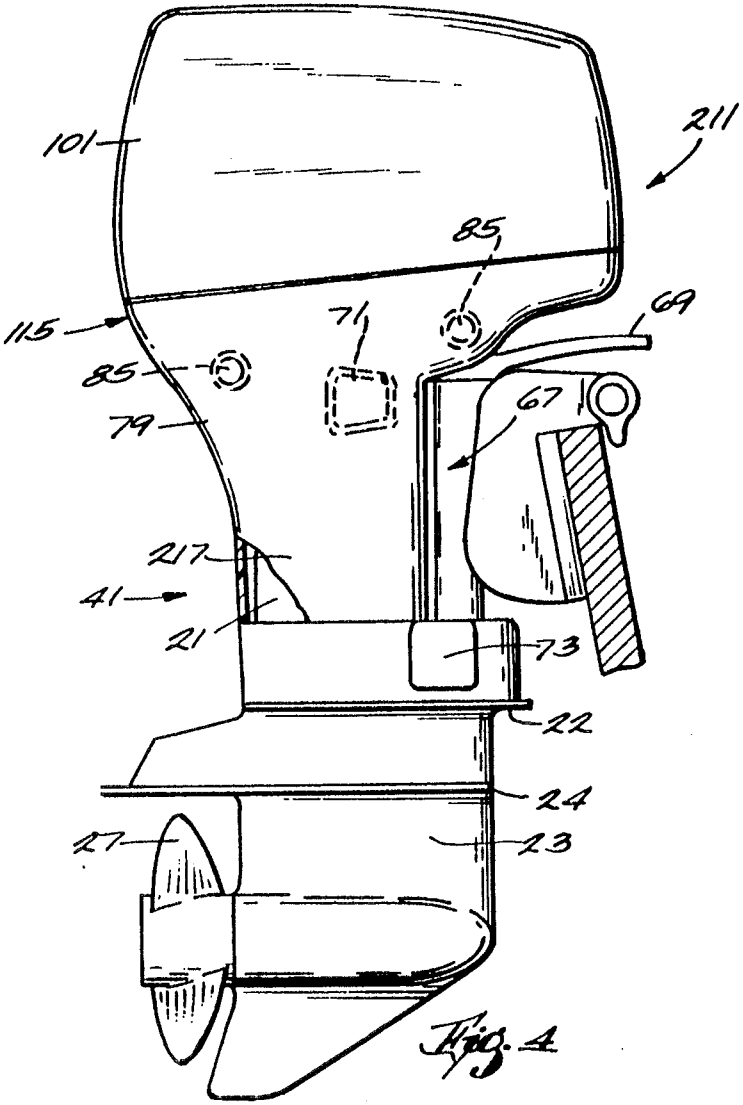
FIG. 4 is a side elevational view, partially in section of another embodiment of an outboard motor incorporating various of the features of the invention.

Shown in FIG. 4 is another embodiment of an outboard motor 211 which is substantially of the same construction as the outboard motor 11 shown in FIG. 1, except that the outboard motor 211 includes skirts 217 (only one shown) which extend to immediately above the lower rubber mounts 73 supporting the propulsion assembly 41 from the king pin assembly 67, rather than to below the lower rubber mounts 73 and to the lower end of the drive shaft housing as in the outboard motor 11. In both cases, the manufacturing cost of finishing the exterior surface of the drive shaft housing 21 is eliminated or materially reduced because the aesthetic considerations with respect to the drive shaft housing can be left out of consideration, and because the weight of the drive shaft housing 21 can be materially reduced. In addition, the disclosed arrangement affords increased freedom for styling changes with minimal structural changes.

The cover assemblies 115 of the outboard motors 11 and 211 include sealing arrangements which are particularly constructed to support a flexible seal or gasket 111 which is fabricated of resilient material and which is operative to reduce the transmission of vibration from the lower covers 77 and 79 to the upper cover, and to protect the seal or gasket 111 from damage. In this regard, the upper cover 101 includes, as shown in FIGS. 5 and 6, a lower margin 300 having therein a circumferentially extending groove 301 with an uppermost portion 303 in the form of a semi-circular blind or closed end, and a pair of laterally spaced and opposed side walls or surfaces 305 and 307 which extend downwardly from the uppermost portion 303 to a horizontally extending bottom surface 309. Preferably the spacing of the side walls 305 and 307 increases slightly from the top to the bottom.

The lower covers or members 77 and 79 include respective projections or upper edges 321 which, when the lower covers 77 and 79 are assembled together, extend circumferentially therearound and into the circumferential groove 301 in the upper cover or member 101. The circumferentially extending upper edges 321 includes an uppermost portion or tip 323 which can be of any desired construction and a pair of laterally spaced and opposed side walls or surfaces 325 and 327 which extend downwardly from the uppermost portion 323 to a horizontally extending ledge or surface 329. The spacing of the side walls or surfaces 325 and 327 increases slightly from the top to the bottom and the overall spacing of the side surfaces 325 and 327 is slightly less than the spacing of the side surfaces 305 and 307 of the circumferential groove 301.

As seen in the sealing arrangement shown in FIG. 5, the gasket 111 is generally circular in cross section and is fixedly attached to the upper cover or member 101 in the uppermost portion 303 of the circumferential groove 301. When the top or upper edges 321 of the lower covers 77 and 79 are received in the circumferential groove 301, the uppermost portions 323 of the top edges 321 engage the seal or gasket 111 to provide a seal between the upper cover 101 and the lower covers 77 and 79, to partially prevent transmission of vibration from the lower covers 77 and 79 to the upper cover 101, and to locate the bottom surface 309 of the upper cover 101 slightly above the ledge or surface 329 of the lower covers 77 and 79. At the same time, the side surfaces 305 and 307 of the circumferential groove 301 respectively extend in closely adjacent relation to the side surfaces 325 and 327 of the top or upper edges 321 so as to horizontally locate and stabilize the upper cover 101 relative to the lower covers 77 and 79.

The sealing arrangement shown in FIG. 6 is generally the same as the sealing arrangement shown in FIG. 5 except that the side surfaces 325 and 327 of the lower covers 77 and 79 are spaced respectively from the side surfaces 305 and 307 of the circumferential groove 301 and the seal or gasket 111 includes an upper portion 331 which, in general, fills the uppermost portion 303 of the circumferential groove 301 and includes two laterally spaced and opposed thin portions 335 and 337 which extend integrally downwardly from the upper gasket portion 331 and which respectively extend into the spaces between the side surfaces 305 and 325 and between the side surfaces 307 and 327, thereby preventing engagement between the side surfaces 305 and 325 and the side surfaces 307 and 327 so as to preclude transmission of vibration from the lower covers 77 and 79 to the upper cover 101, and to seal the cover members 77, 79, and 101 so as to prevent entry of water.

Various of the features of the invention are set forth in the following claims.

We claim:

1. An outboard motor comprising a propulsion unit including a lower unit comprising a drive shaft housing having an upper end and a lower end, a gear case attached to said lower end of said drive shaft housing, and a propeller shaft supported by said gearcase, a power head including an engine fixedly attached to said upper end of said drive shaft housing, and an engine cover assembly comprising a starboard lower cover member extending downwardly to said lower end of said drive shaft housing, a port lower cover member extending downwardly to said lower end of said drive shaft housing, and means connecting together said port and starboard cover members independently of said lower unit and in surrounding covering relation to said drive shaft housing, and means resiliently supporting said lower cover members on said lower unit.

2. An outboard motor in accordance with claim 1 and further including means for fixing said propulsion unit to a boat transom including a transom bracket adapted to be attached to the boat transom, a swivel bracket connected to said transom bracket for vertical tilting movement about a horizontal axis and including therein a bore extending transversely to said horizontal axis and defining a steering axis, and a king pin extending in said swivel bracket and having an upper end and a lower end, an upper rubber mount connecting said king pin to said an upper end of said drive shaft housing, and a lower rubber mount connecting said king pin to said lower end of said drive shaft housing, and wherein said lower cover members extend to below said lower rubber mount.

3. An outboard motor in accordance with claim 2 wherein said lower cover members include lower forwardly projecting portions which enclose said lower mount and which include respective upper surfaces respectively having therein mating half openings which form an aperture through which said king pin passes.

4. An outboard motor in accordance with claim 1 wherein said drive shaft housing includes, at the bottom thereof, a horizontally extending splash plate, and wherein said skirts extend to said splash plate.

5. An outboard motor in accordance with claim 1 and further including means for fixing said propulsion unit to a boat transom including a transom bracket adapted to be attached to the boat transom, a swivel bracket connected to said transom bracket for vertical tilting movement about a horizontal axis and including therein a bore extending transversely to said horizontal axis and defining a steering axis, a king pin extending in said swivel bracket and having an upper end and a lower end, an upper rubber mount connecting said king pin to said an upper end of said drive shaft housing, and a lower rubber mount connecting said king pin to said lower end of said drive shaft housing, and wherein said lower cover members extend to immediately above said lower rubber mount.

6. A cover assembly for a propulsion assembly forming part of an outboard motor, said cover assembly comprising a lower cover including an upper margin with an upper edge and laterally spaced and opposed side surfaces extending downwardly from said upper edge, a top cover having a lower margin with a circumferential groove receiving said upper margin of said lower cover and defined by laterally spaced and opposed side surfaces in respective laterally adjacent relation to said laterally spaced and opposed side surfaces of said upper margin, and a gasket fixed on said upper cover member in said groove and engaged by said upper margin of said lower cover.

7. A cover assembly in accordance with claim 6 wherein said groove also includes an uppermost portion above said laterally spaced and opposed side surfaces of said groove, and wherein said upper margin includes an uppermost portion above said laterally spaced and opposed side surfaces of said upper margin.

8. A cover assembly in accordance with claim 7 wherein said side surfaces of said groove include upper and lower ends which are more widely spaced at said lower ends than at said upper ends, wherein said side surfaces of said upper margin include upper and lower ends which are more widely spaced at said lower ends than at said upper ends, and wherein said spacing of said side surfaces of said upper margin is greater than said spacing of said side surfaces of said groove.

9. A cover assembly in accordance with claim 8 wherein said gasket includes a main portion located in said uppermost portion of said groove and engaged by said uppermost portion of said upper margin, and laterally spaced and opposed portions extending integrally and downwardly from said main portion and engaged with said laterally spaced side surfaces of said groove and said upper margin.

10. An outboard motor comprising a propulsion unit including a lower unit having port and starboard sides and comprising a drive shaft housing having an upper end and a lower end, a gear case attached to said lower end of said drive shaft housing, and a propeller supported by said gearcase, a power head including an engine fixedly attached to said upper end of said drive shaft housing, and an engine cover assembly comprising a starboard lower cover member extending downwardly to said lower end of said drive shaft housing and including an inwardly open recess and an upper edge, a port lower cover member extending downwardly to said lower end of said drive shaft housing and including an inwardly open recess and an upper edge, means connecting together said port and starboard cover members independently of said lower unit and in surrounding covering relation to said drive shaft housing, a top cover surrounding said power head and having a lower margin with a circumferential groove receiving said upper edges of said lower covers, and a gasket fixed on said upper cover member in said groove and engaged by said upper edge, means resiliently supporting said lower cover members on said lower unit and including rubber mounts respectively extending from said port and starboard sides of said lower unit and into said inwardly open recesses of said lower cover members.

11. An outboard motor in accordance with claim 1 and further including means for fixing said propulsion unit to a boat transom including a transom bracket adapted to be attached to the boat transom, a swivel bracket connected to said transom bracket for vertical tilting movement about a horizontal axis and including therein a bore extending transversely to said horizontal axis and defining a steering axis, and a king pin extending in said swivel bracket and having an upper end and a lower end, an upper rubber mount connecting said king pin to said an upper end of said drive shaft housing and a lower rubber mount connecting said king pin to said lower end of said drive shaft housing, and wherein said lower cover members extend to below said lower rubber mount.

12. An outboard motor in accordance with claim 11 wherein said lower cover members include lower forwardly projecting portions which enclose said lower mount and which include respective upper surfaces respectively having therein mating half openings which form an aperture through which said king pin passes.

13. An outboard motor in accordance with claim 10 wherein said drive shaft housing includes, at the bottom thereof, a horizontally extending splash plate, and wherein said skirts extend to said splash plate.

14. An outboard motor in accordance with claim 10 and further including means for fixing said propulsion unit to a boat transom including a transom bracket adapted to be attached to the boat transom, a swivel bracket connected to said transom bracket for vertical tilting movement about a horizontal axis and including therein a bore extending transversely to said horizontal axis and defining a steering axis, a king pin extending in said swivel bracket and having an upper end and a lower end, an upper rubber mount connecting said king pin to said an upper end of said drive shaft housing and a lower rubber mount connecting said king pin to said lower end of said drive shaft housing, and wherein said lower cover members extend to immediately above said lower rubber mount.

15. A cover assembly in accordance with claim 10 wherein said groove includes an uppermost portion and laterally spaced and opposed side surfaces extending downwardly from said uppermost portion, and wherein said upper edges include an uppermost portion and laterally spaced and opposed side surfaces extending downwardly from said uppermost portions of said top edges and within said groove.

16. A cover assembly in accordance with claim 15 wherein said side surfaces of said groove include upper and lower ends which are more widely spaced at said lower ends than at said upper ends, wherein said side surfaces of said upper edges include upper and lower ends which are more widely spaced at said lower ends than at said upper ends, and wherein said spacings of said side surfaces of said upper edges is greater than said spacing of said side surfaces of said groove.

17. A cover assembly in accordance with claim 16 wherein said gasket includes a main portion located in said uppermost portions of said groove and engaged by said uppermost portions of said upper edges, and laterally spaced and opposed portions extending integrally and downwardly from said main portion and engaged with said downwardly extending laterally spaced side surfaces of said groove and said upper edges.

* * * * *